US008122652B2

(12) United States Patent
Knight et al.

(10) Patent No.: US 8,122,652 B2
(45) Date of Patent: Feb. 28, 2012

(54) BRIDGING BEAM

(75) Inventors: John Keith Knight, Donvale (AU); Beverly Anne Knight, legal representative, Donvale (AU); Robert Edwin Randell, Ferntree Gully (AU); Carmel Geraldine Chell, Wantirna South (AU)

(73) Assignee: Andoria Pty Ltd, Portsmith, Queensland (AU)

( * ) Notice: Subject to any disclaimer, the term of this patent is extended or adjusted under 35 U.S.C. 154(b) by 932 days.

(21) Appl. No.: 10/585,829

(22) PCT Filed: Dec. 10, 2004

(86) PCT No.: PCT/AU2004/001733

§ 371 (c)(1),
(2), (4) Date: Jul. 16, 2009

(87) PCT Pub. No.: WO2005/068750

PCT Pub. Date: Jul. 28, 2005

(65) Prior Publication Data

US 2010/0024356 A1 Feb. 4, 2010

(30) Foreign Application Priority Data

Jan. 13, 2004 (AU) ..... 2004900120

(51) Int. Cl.
*E02D 27/42* (2006.01)

(52) U.S. Cl. ..... 52/170; 52/741.14; 52/835

(58) Field of Classification Search ..... 52/153, 52/170, 741.11, 741.14, 745.17, 745.18, 52/835, 848, 849
See application file for complete search history.

(56) References Cited

U.S. PATENT DOCUMENTS

| | | | | | |
|---|---|---|---|---|---|
| 1,672,789 | A | * | 6/1928 | Spring | 52/170 |
| 1,817,342 | A | * | 8/1931 | Beecher | 52/170 |
| 2,090,972 | A | * | 8/1937 | Allen | 52/170 |
| 3,420,032 | A | * | 1/1969 | Felt | 52/844 |
| 4,697,396 | A | * | 10/1987 | Knight | 52/170 |
| 5,442,885 | A | * | 8/1995 | Laven et al. | 52/844 |
| 5,815,994 | A | * | 10/1998 | Knight et al. | 52/170 |
| 6,151,860 | A | * | 11/2000 | Reisdorff | 52/651.02 |

FOREIGN PATENT DOCUMENTS

| | | |
|---|---|---|
| EP | 0 178 842 | 5/1989 |
| JP | 9-287318 | 11/1997 |
| WO | WO 84/04348 | 11/1984 |
| WO | WO 88/03593 | 5/1988 |

* cited by examiner

*Primary Examiner* — Brian Glessner
*Assistant Examiner* — Adriana Figueroa
(74) *Attorney, Agent, or Firm* — Volpe and Koenig, P.C

(57) ABSTRACT

A method of reinstating a pole standing upright in ground comprising, abutting an inner surface of a sleeve of a bridging beam against an outer surface of the pole so as to have a lower portion of the bridging beam penetrating the ground and an upper portion of the bridging beam projecting above the ground, arranging a plurality of locating members around the outer surface of the pole, and securing the bridging beam to the pole by strapping surrounding the pole held in place with respect to the pole by the locating members.

11 Claims, 4 Drawing Sheets

BRIDGING BEAM

FIELD OF THE INVENTION

This invention relates to methods for reinstating poles. It particularly relates to using one or more bridging beams to reinstate poles and to bridging beam constructions.

BACKGROUND OF THE INVENTION

The use of bridging beams to reinstate poles used by utilities for carrying communications lines, electric power lines and the like has become an effective means for extending the lifetime of damaged, rotted or weakened poles. Whilst bridging beams have specifically been used to reinstate poles used by utilities, it is to be appreciated that this technique has application to other forms of poles including pylons, stumps, flagpoles, warning posts and the like and as such, the invention also has application in these alternative situations.

Bridging beams have particular application to wooden poles. It is well known that a wooden pole is most vulnerable to rot, decay or similar degradation at about ground level including the area from slightly above to slightly below the ground line of the standing poles. This is the area in which rot generally begins and as the decay spreads, the pole is weakened. If a utility pole should fail, there may be serious disruption to telecommunications and/or power supply. Further, the sudden failure of a pole is a risk which linesman working on such poles face regularly. In addition to the risks of a faulty pole falling and bringing down not only the lines but also the linesman with it, there are risks to passersby and neighbouring buildings or other structures. Similar dangers and inconvenience may result from the failure of poles used in other applications.

Thus, the reinstatement of damaged poles is an important consideration. However, it can be difficult to properly identify damage to a pole. Accordingly it may sometimes be necessary or advisable to provide added strength to a sound pole. The terms reinstate and reinstatement are accordingly used herein to refer to the addition of strength to a pole irrespective of whether the pole has been previously damaged and/or weakened in any way.

Typically, a pole may be reinstated by securing a bridging beam to the surface of a pole over the region where it is rotted or weakened. The bridging beam may be securely attached by drilling holes diametrically through the pole and securing the bridging beam to the pole by bolts extending completely through the material of the pole. Where a pole is particularly weakened, two or even more bridging beams may be applied in this fashion.

Whilst such approaches have met with a degree of success, the fact that holes need to be drilled through the hole diameter means that the actual wood or other material comprising the pole is further weakened by virtue of the removal of material through drilling. Clearly this is one aspect of the process which is directly contrary to achieving the desired object.

To some extent, the problems caused by weakening the pole through drilling holes may be overcome by using a stronger bridging beam or using multiple bridging beams. However, as the use of stronger or multiple bridging beams inevitably leads to increased costs, it would be preferable to be able to use a weaker bridging beam if the integrity of the pole can be retained by avoiding the use of holes drilled completely through the pole.

It would also be advantageous to be able to provide a basic bridging beam design which can be reinforced to increase its strength.

This invention seeks to provide bridging beam designs and/or methods of installing bridging beams which may be of assistance in meeting one or more of the desirable aspects of bridging beams discussed above.

DISCLOSURE OF THE INVENTION

The invention provides in one aspect a method of reinstating a pole standing upright in ground comprising, abutting an inner surface of a sleeve of a bridging beam against an outer surface of the pole so as to have a lower portion of the bridging beam penetrating the ground and an upper portion of the bridging beam projecting above the ground, arranging a plurality of locating members around the outer surface of the pole, and securing the bridging beam to the pole by strapping surrounding the pole and held in place with respect to the pole by the locating members.

Suitably the bridging beam includes an elongate raised portion extending outwardly from the sleeve for a substantial proportion of the length of the sleeve.

Suitably each of the locating members is fitted in a hole. The hole may extend into the pole for a depth substantially less than the radius of the pole.

One or more of the locating members may extend through a hole in the sleeve. The locating members may comprise ferrules.

The strapping may comprise one or more straps of flexible material secured around the pole. The strapping material may extend through holes formed in the raised portion. Typically, the strapping material may comprise flexible metal strip. Suitably between two and twelve straps may be used to secure the bridging beam to the pole. More preferably four to eight straps may be used. The straps may be arranged at different positions along the length of the pole.

The holes for the locating members may typically be 1 cm to 10 cm deep. More preferably they may be between 2 cm and 6 cm deep. The holes may have a circular cross section. Alternatively, the holes may be annular. They may be bored into the wood of a pole in such a fashion that the ferrules can snugly fit in the holes.

Suitably, the ferrules may have an open mouth of greater diameter than the diameter of the holes. The open mouth may be shaped so as to receive a keeper for holding the strapping. Typically, the keeper may comprise a generally circular portion for fitting in the open mouth of the ferrule and two opposed upwardly extending arm members which are adapted to hold the strapping in place.

Typically two to eight locating members may be used around the pole per strap. More preferably, three to five locating members may be used.

A sealant may be applied in the holes. The sealant may comprise a gel sealant. It may comprise boron fluoride.

A brace may be fitted within the raised portion to reinforce the raised portion. The brace may be arranged so as to brace the raised portion and hence the bridging beam in radial and tangential directions relative to the bridging beam.

The brace may include holes for allowing the strapping to pass through the brace. The brace may be shaped as a box section. It may be shaped so as to fit snugly within the raised portion. It may be secured within the raised portion by a hook member provided on the inside of the raised portion.

Typically, the length of the brace may comprise 20% to 100% of the length of the raised portion. More preferably it may comprise between 20% and 50% of the length of the raised portion. It may be located so that it spans the region of the pole spanning the ground level.

In another aspect the invention provides a bridging beam for bridging a weakened area of a pole comprising, a sleeve for abutting an outer surface of a pole, a raised portion extending outwardly from the sleeve for a substantial proportion of the length of the sleeve whereby to form an elongate cavity, and an elongate insert held within the cavity, wherein the elongate insert comprises a brace constructed to brace the sleeve.

Suitably the brace is constructed so as to brace the sleeve in radial and tangential directions relative to the sleeve.

The sleeve may be formed with flanges extending along its opposed lengthwise edges. The flanges may be provided with holes through which the strapping may be fitted.

The bottom end of the bridging beam may be shaped so as to facilitate penetration of the bridging beam into the ground. Thus, the sleeve end may have a generally arrow head shape and the raised portion may terminate in a cambered edge.

Preferred aspects of the invention will now be described with reference to the accompanying drawings.

DETAILED DESCRIPTION OF THE PREFERRED EMBODIMENTS

Figures 1, 2, 3, 4:
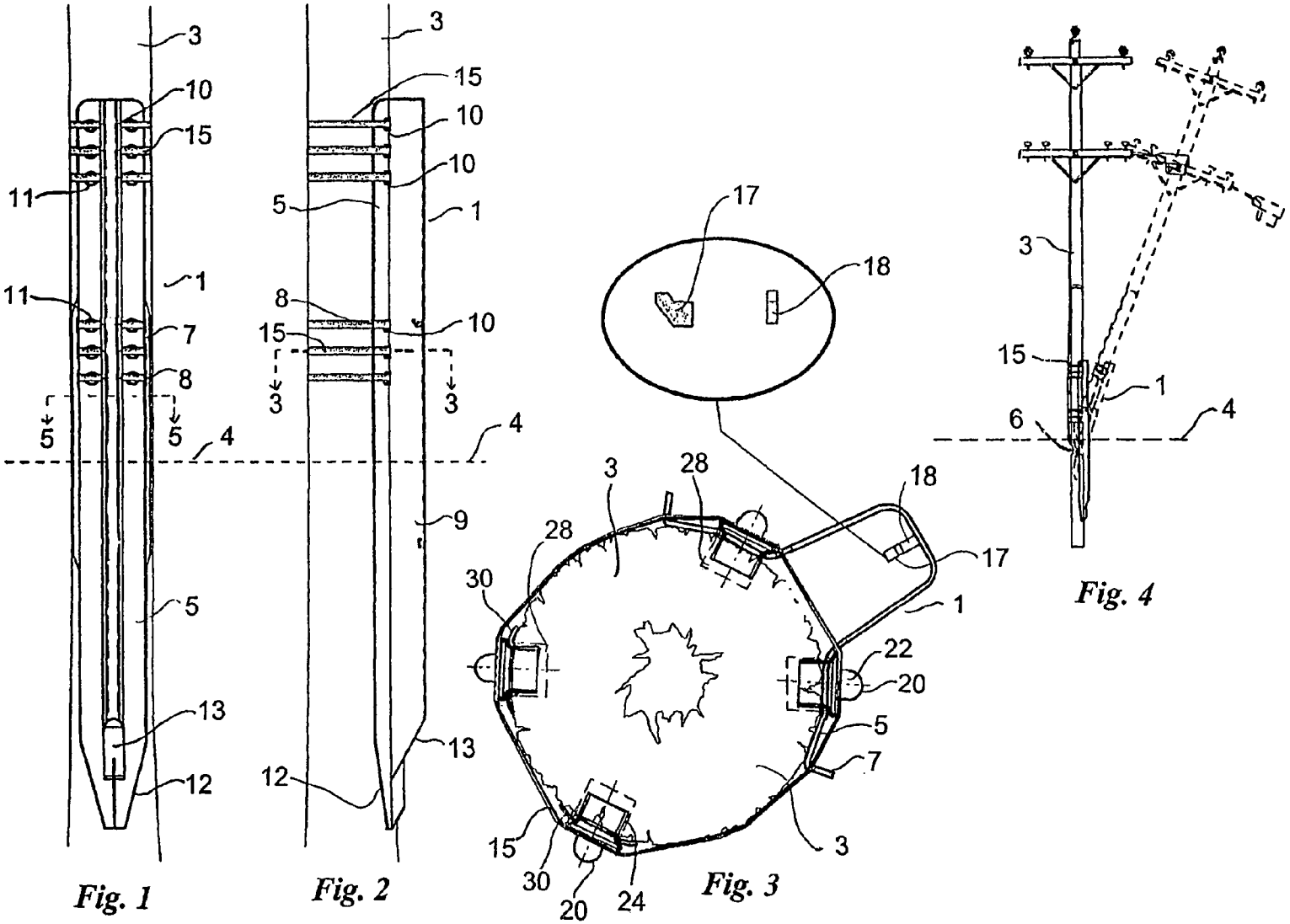
FIG. 1 shows an elevational view of a bridging beam applied to a pole in accordance with the invention.
FIG. 2 shows a side on elevational view of FIG. 1.
FIG. 3 shows the section 3-3 taken on FIG. 2.
FIG. 4 shows an elevational view of a bridging beam according to the invention applied to a rotted area of a pole at designed failure mode as shown by the pole illustrated with dotted lines.
Figure 6:
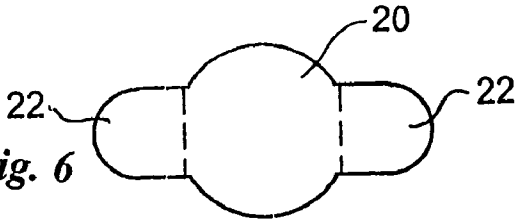
FIG. 6 shows a plan view of a flat piece of metal which can be bent to form a keeper.
Figure 7:
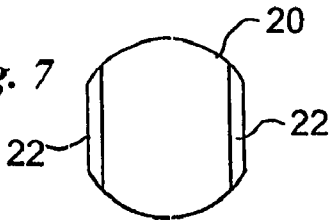
FIG. 7 shows a plan view of a keeper bent from the metal piece shown in FIG. 6.
Figure 8:
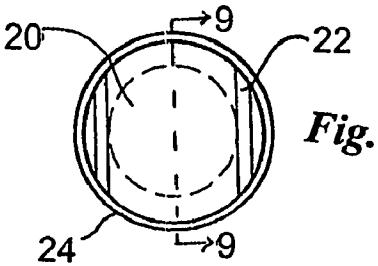
FIG. 8 shows a plan view of a ferrule and keeper.
Figure 9:
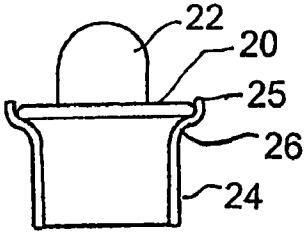
FIG. 9 shows the section 9-9 taken through FIG. 8.
Figure 5:
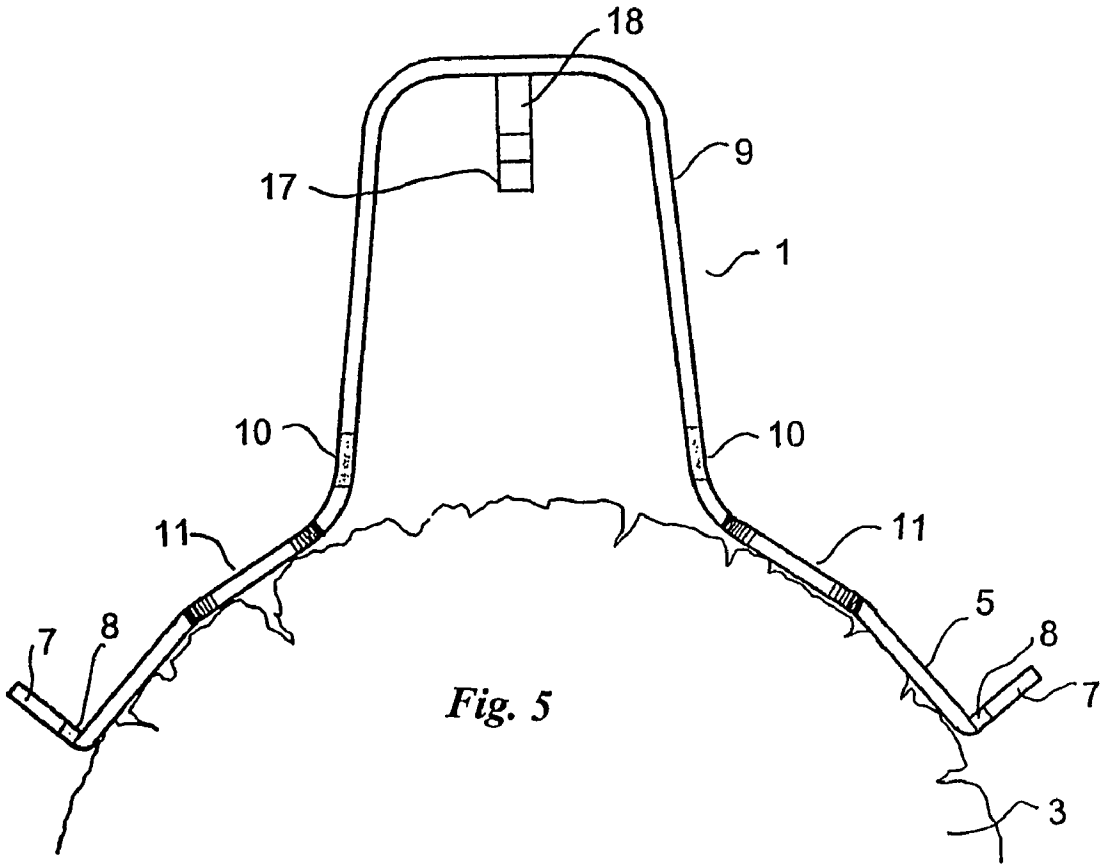
FIG. 5 shows a fragmentary view of the section 5-5 taken on FIG. 1.
Figures 10, 11, 12, 13:
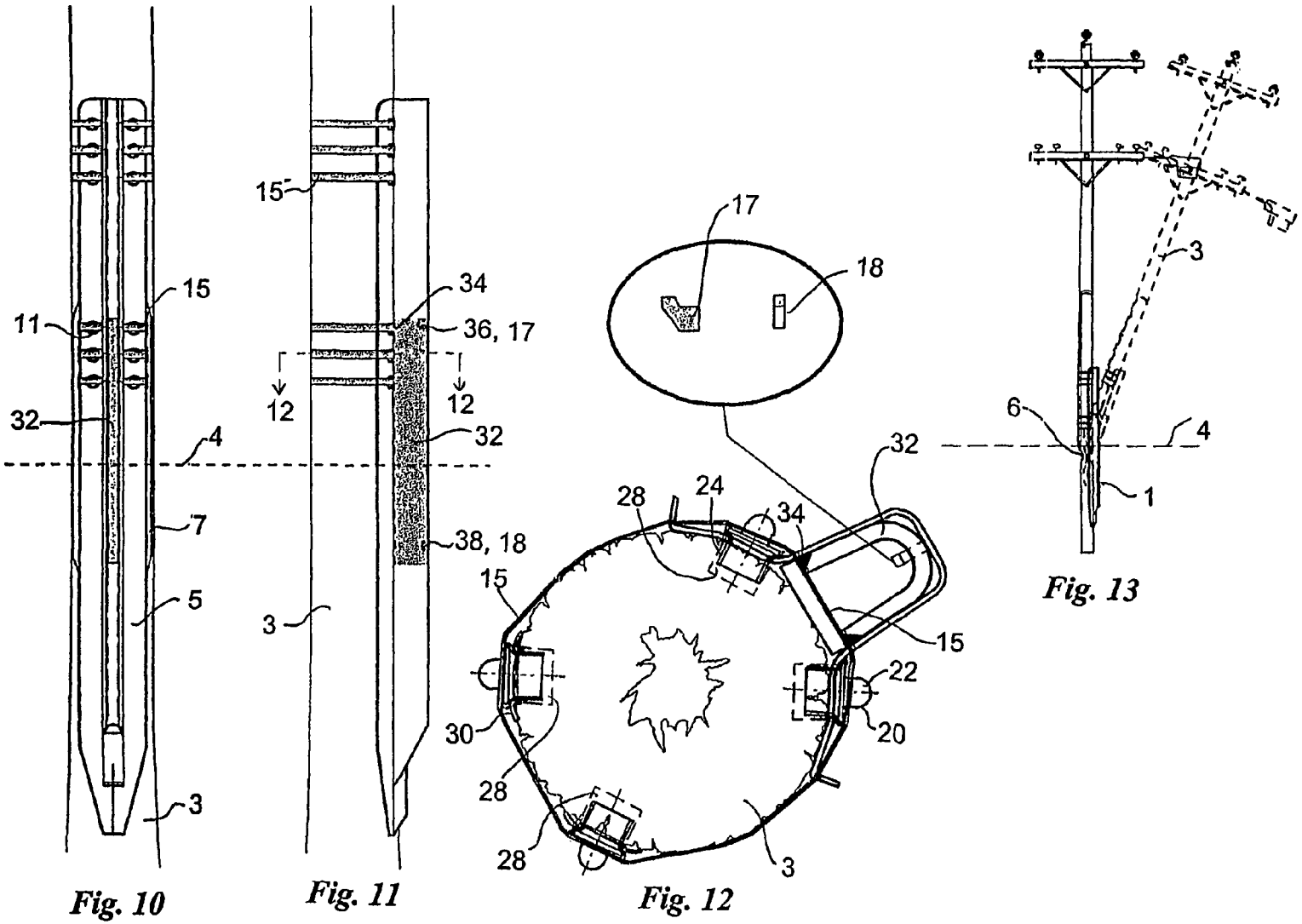
FIG. 10 shows an elevational view of a bridging beam and brace applied to a pole.
FIG. 11 shows a side on elevational view of FIG. 10.
FIG. 12 shows the section 12-12 taken on FIG. 11.
FIG. 13 shows the bridging beam of FIGS. 10 and 11 applied across a rotted region of a pole.
Figure 15:
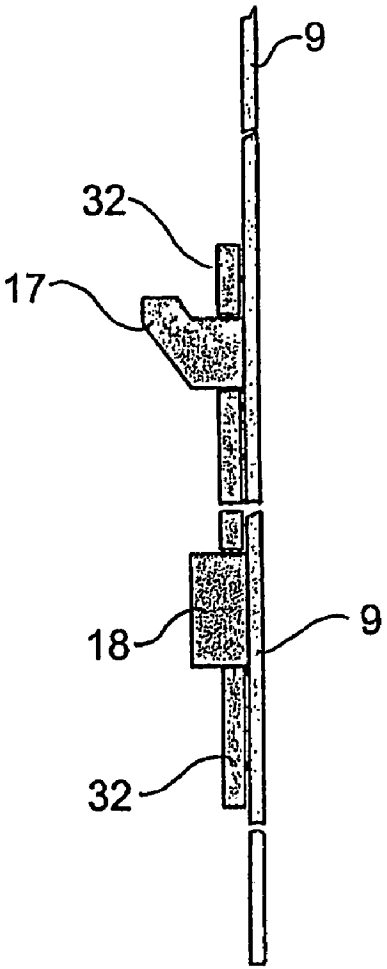
FIG. 15 shows a fragmentary section 15-15 taken on FIG. 14.
Figure 14:
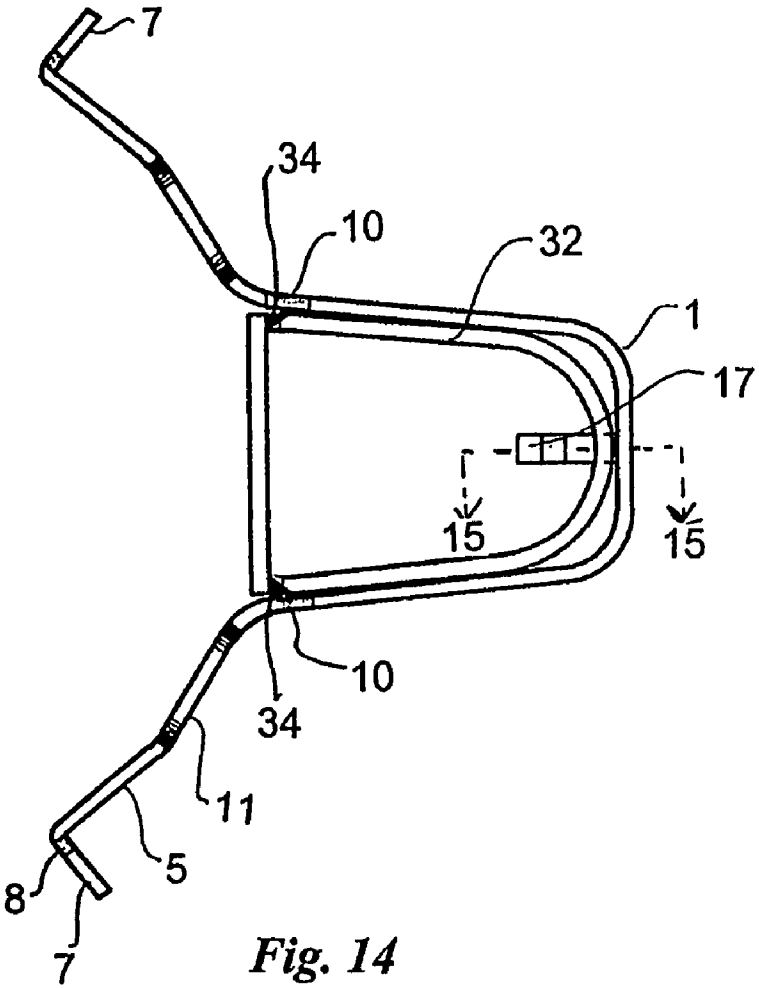
FIG. 14 shows a cross section taken through the bridging beam shown in FIG. 10.

The various elements identified by numerals in the drawings are listed in the following integer list.

INTEGER LIST

1 Bridging beam
3 Pole
4 Ground level
5 Sleeve
6 Rotted region
7 Flange
8 Hole
9 Raised portion
10 Hole
11 Hole
12 Arrowhead
13 Cambered edge
15 Strapping
17 Hook
18 Stop
20 Keeper
22 Arm
24 Ferrule
25 Mouth
26 Step
28 Recess
30 Washer
32 Brace
34 Hole
36 Aperture
38 Aperture Referring to FIGS. 1 to 5 of the drawings, there is shown a bridging beam generally designated 1 which has been applied to reinstate a pole 3.

The bridging beam has been applied to the pole across the regions spanning the ground level 4 which is where there is the greatest likelihood of finding a rotted region 6 acting to weaken the pole.

The bridging beam may typically be formed from a sheet of steel by conventional forming operations as are known in the art eg. roll forming. It includes a sleeve 5 shaped so as to snugly fit the surface of the pole 3. The central portion of the bridging beam along its length is provided with a raised portion 9 extending outwardly from the pole. Thus, there is a cavity enclosed between the surface of the pole and the raised portion 9.

Flanges 7 are provided along the lengthwise edges of the sleeve to lend stiffness. Holes 8 are provided in the flanges to allow strapping 15 to be passed therethrough.

Similarly, holes or slots 10 are provided on the raised portion to allow the strapping to pass therethrough and through the cavity mentioned above.

Holes 11, are formed in the sleeve to receive the ferrules 24 in the manner which will be described hereinafter.

In order to facilitate penetration of the bridging beam into the ground as it is applied to reinforce a pole, the bottom of the sleeve is formed in the general shape of an arrow head 12 and the raised portion terminates in a cambered edge 13. Thus the bridging beam is initially located in abutment with the bottom end in contact with the ground. The bridging beam is then driven into the ground so that the lower portion of the bridging beam lies underneath the ground and the upper portion projects above the ground.

After driving the bridging beam into the ground six lines of straps 15 completely encircle the pole and hold the bridging beam thereto tightly. The straps may typically be metal straps as are known in the art. These straps are held in place longitudinally with respect to the surface of the pole by locating members comprising a combination of the ferrules 24 and keepers 20 shown in more detail in FIGS. 6 to 9.

The keepers 20 comprise a central generally circular portion provided on opposite sides with arms 22. Going from FIG. 6 to FIG. 7 it can be seen that the arms have been bent so that they point upwards defining a space therebetween which is wide enough to accommodate the width of one of the straps 15. The keeper sits snugly in the mouth 25 of the ferrule 24. As the mouth is wider than the main body of the ferrule it forms a step 26 upon which the central portion of the ferrule rests.

As can be seen more clearly in FIG. 3, the locating members comprising the ferrule and keeper, are each seated in a hole 28. The hole may typically be 2 cm to 5 cm deep. It may be reamed out completely or it may in the form of an annular or other shaped channel to receive the lower portion of the body of the ferrule. A gel sealant such as boron fluoride may be put into the hole before the ferrule is inserted. The ferrule may sit in a washer 30 to spread the pressure from the ferrule and strapping more evenly. Alternatively the locating members may be secured to the outer surface of the pole by other means such as by nails, screws, glues, etc.

Referring to FIGS. 10 to 13, there is shown an arrangement which is very similar to that already described with reference to FIGS. 1 to 9, the only significant difference being the inclusion of a brace 32 within the cavity formed between the raised portion 9 and pole. The brace is formed as a box section and fits snugly within the cavity. Apertures 36 and 38 are provided in the brace to co-operate with the hook 17 and stop 18 respectively to hold the brace in place during application of the bridging beam to the pole. The hook 17 and stop 18 project inwardly from the inside surface of the raised portion. Typically, the brace may extend for about a third of the length of the raised portion and will be located in a region spanning the length of the pole above and below the ground level.

The brace includes holes 34 to accommodate the strapping 15 and it is ideally shaped so that it fits generally snugly within the raised portion. Providing the fit is sufficiently snug and tight, a well constructed box section brace should brace the sleeve and hence the bridging beam in both radial and tangential directions.

Whilst the above description includes the preferred embodiments of the invention, it is to be understood that many variations, alterations, modifications and/or additions may be introduced into the constructions and arrangements of parts previously described without departing from the essential features or the spirit or ambit of the invention.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

The reference to any prior art in this specification is not, and should not be taken as, an acknowledgment or any form of suggestion that such prior art forms part of the common general knowledge in Australia.

The invention claimed is:

1. A method of reinstating a pole standing upright in the ground comprising, abutting an inner surface of a sleeve of a bridging beam against an outer surface of the pole so as to have a lower portion of the bridging beam penetrating the ground and wherein the bridging beam includes an elongated raised portion extending outwardly from the sleeve for a substantial proportion of the length of the sleeve, arranging a plurality of locating members around the outer surface of the pole, and securing the bridging beam to the pole by strapping surrounding the pole held in place with respect to the pole by the locating members, wherein the bridging beam is reinforced by securing a brace in a channel shaped cavity formed by the elongate raised portion prior to abutting the bridging beam against the pole.

2. The method according to claim 1 wherein the bridging beam is initially abutted against the pole with the bottom of the bridging beam resting on the ground and the bridging beam is driven into the ground whilst maintaining the bridging beam in abutment with the pole.

3. The method according to claim 1 wherein, locating holes are cut so that they extend radially into the pole from the outer surface of the pole, the locating holes having a depth substantially less than the radius of the pole, and the locating members are disposed to extend into and be held in the locating holes.

4. The method according to claim 1 wherein the locating members extend through corresponding locating holes in the sleeve.

5. The method according to claim 1 wherein at least four straps arranged at different positions along the length of the pole are used to secure the bridging beam to the pole.

6. The method according to claim 5 wherein at least two locating members are used to hold each strap in place.

7. A pole reinstated in accordance with the method of claim 6.

8. A bridging beam assembly comprising a bridging beam, locating members and strapping as defined in claim 1 when used in a method for reinstating a pole as defined in claim 1.

9. A bridging beam for reinstating a pole comprising, an elongate sleeve shaped so as to be able to abut the surface of the pole parallel to the longitudinal axis of the pole, an elongate longitudinally extending raised portion of the sleeve forming a channel shaped cavity, a brace shaped so as to generally fit snugly in the channel shaped cavity, and securement means for removably securing the brace within the cavity, wherein the securement means comprise a hook member and a stop member mounted in the channel shaped cavity, the hook member and stop member each extending into an aperture formed in the brace, and a pair of longitudinally extending edges on opposite sides of the elongate sleeve each provided with a flange arranged so as to extend outwardly from the pole.

10. The bridging beam according to claim 9 comprising opposed holes in opposite sides of the raised portion positioned so as to align with corresponding holes in the brace, the arrangement of holes being such that strapping may be threaded through the opposed holes and corresponding holes to allow the strapping to pass through the bridging beam and encircle the pole.

11. The bridging beam according to claim 10 comprising a pair of longitudinally extending edges on opposite sides of the elongate sleeve each provided with a flange arranged so as to extend outwardly from the pole wherein each flange is provided with complementary holes through which the strapping may be fed.

* * * * *